United States Patent [19]

O'Connor

[11] Patent Number: 4,784,604

[45] Date of Patent: Nov. 15, 1988

[54] AIR PULSATION FOR COMBUSTORS

[75] Inventor: Chadwell O'Connor, Newport Beach, Calif.

[73] Assignee: Westinghouse Electric Corp., Pittsburgh, Pa.

[21] Appl. No.: 97,266

[22] Filed: Sep. 17, 1987

Related U.S. Application Data

[63] Continuation of Ser. No. 942,569, Dec. 15, 1986, abandoned.

[51] Int. Cl.[4] ..... F27B 7/08

[52] U.S. Cl. ..... 432/107; 110/246; 432/118

[58] Field of Search ..... 432/103, 105, 107, 112, 432/113, 117; 110/246

[56] References Cited

U.S. PATENT DOCUMENTS

| | | | |
|---|---|---|---|
| 3,822,651 | 7/1974 | Harris et al. | 110/246 |
| 4,014,106 | 3/1977 | Bearce | 432/107 |
| 4,191,530 | 3/1980 | Bearce | 432/107 |
| 4,226,584 | 10/1980 | Ishikawa | 432/118 |
| 4,349,969 | 9/1982 | Stewart et al. | 110/245 |

*Primary Examiner*—Henry C. Yuen

*Attorney, Agent, or Firm*—F. J. Baehr, Jr.

[57] ABSTRACT

A combustor for burning MSW (municipal solid waste) having a porous wall drum in which burning takes place with combustion air supplied from outside of the drum, in which air driven through the drum into the material being burned is supplied in pulses.

1 Claim, 2 Drawing Sheets

AIR PULSATION FOR COMBUSTORS

This application is a continuation, of application Ser. No. 942,569, filed Dec. 15, 1986 now abandoned.

This invention relates generally to rotary kilns, of the kind becoming known as combustors, for burning waste, and the invention more particularly concerns supplying combustion air to such a structure.

U.S. Pat. No. 3,822,651, issued June 9, 1974, discloses an installation found especially useful for burning MSW (municipal solid waste) and at the same time generating useful steam. Burning takes place in a combustor drum consisting of a long cylindrical structure formed by water circulating pipes slowly rotating on the drum axis. The drum is inclined at a slight angle so that material to be burned which is fed into the higher end of the drum tumbles gradually toward the lower end. Air for burning is fed through holes formed between the pipes making up the cylindrical drum wall, and the air flow is controlled by ducts fitting adjacent the lower portions of the rotating drum.

Any burning reaction involves bringing combustion air into intimate contact with the material to be burned. When burning a mass of material such as MSW, it is sometimes difficult to get the air into the mass. If significant pressure is applied to the air to facilitate penetration, then the air volume and motion is not conducive to establishing the best burning conditions.

When open hearth fireplaces were commonly used for heat and cooking, a standard fireplace tool was a bellows. For reasons not too clear, using a bellows to pulse air into a fire appears to facilitate burning out of proportion to the effect of merely increasing the air supply. Perhaps the air under pressure during a pulse penetrates the material being burned, and the intervals between pulses allows the augmented air to completely participate in the burning reaction.

It is an object of the invention to provide a method and apparatus for augmenting the burning reaction in a combustor by using the apparent principle of a bellows-like action. A related object is to provide an apparatus of the foregoing kind that is simple and reliable, so as to be economical to manufacture and maintain.

Other objects and advantages of the invention will become apparent upon reading the following detailed description, and upon reference to the drawings, in which.

Figure 1:
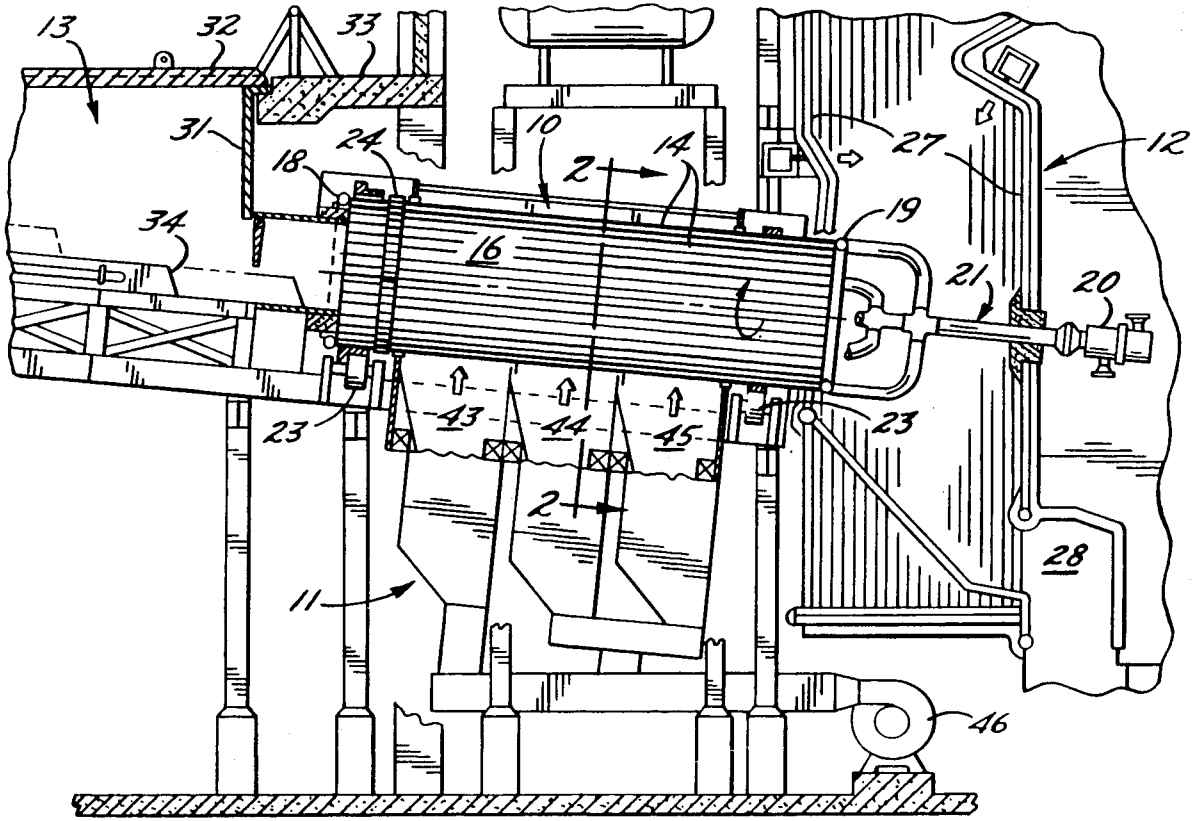
FIG. 1 is a fragmentary partially sectioned elevation of a structure for burning MSW including a combustor air supply embodying the invention.
Figure 3:
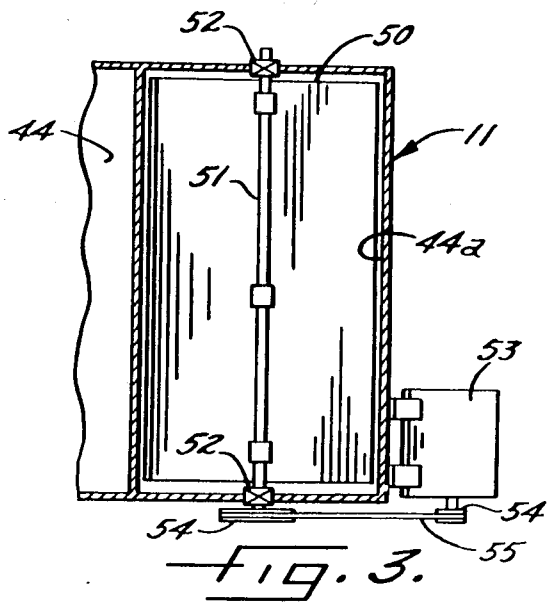
FIG. 3 is a fragmentary section taken along the line 3—3 in FIG. 2.
Figure 2:
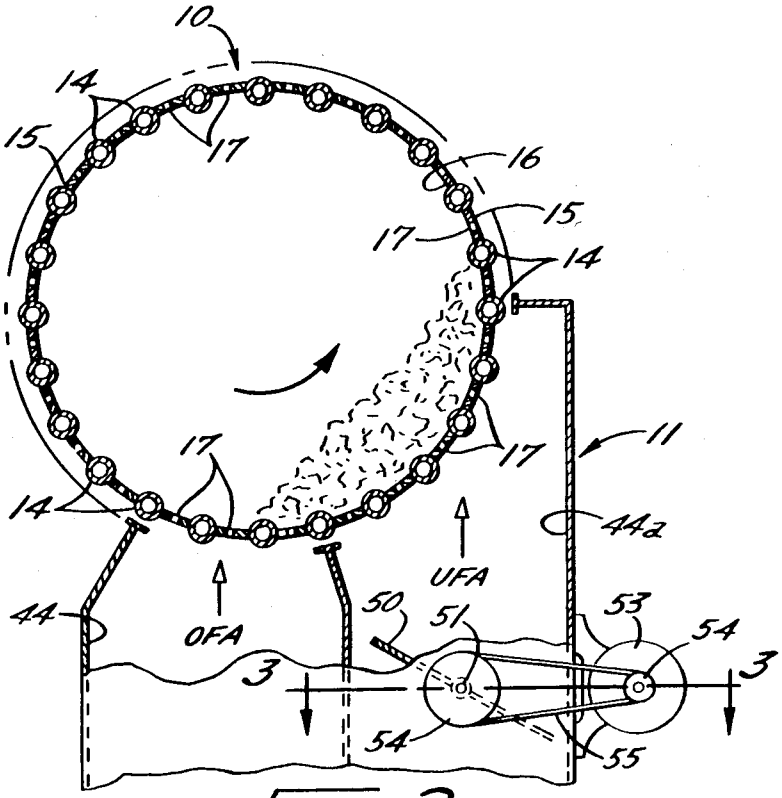
FIG. 2 is an enlarged fragmentary section taken approximately along the line 2—2 in FIG. 1.

While the invention will be described in connection with a preferred embodiment, it will be understood that I do not intend to limit the invention to that embodiment. On the contrary, I intend to cover all alternatives, modifications and equivalents within the spirit and scope of the invention as defined by the appended claims.

Turning to the drawing, there is shown a structure for burning material such as MSW and including a rotary combustor 10 with a windbox 11 for delivering air to the combustor, a furnace 12, and an arrangement 13 for feeding combustible material into the combustor. The combustor 10 is formed of a plurality of water-cooled pipes 14 joined together by perforated strips 1 welded between the pipes to define a cylinder 16. The perforations of the strips 15 consist of a plurality of holes or openings 17 running the length of the cylinder 16.

The pipes 14 end in annular header pipes 18 and 19 at each end of the cylinder. A rotary joint 20 feeds water to, and removes steam and hot water from, the combustor 10 through concentric pipes 21. Water is directed to the header pipe 19 and thence to the combustor pipes 14, and steam from the header pipe 18 is carried back through certain ones of the combustor pipes 14 that do not carry input water and which communicate directly with the steam portion of the pipes 21.

The combustor 10 is mounted for rotation about the axis of the cylinder 16 on support rollers 23 with the axis being tilted so that the combustor has a high end and a low end. The combustor is slowly rotated through a sprocket 24 in the direction of the arrows.

The furnace 12 is defined by a plurality of boiler pipes 27 having a side opening for the combustor and a bottom open 28 for ashes and nonburnable materials. The arrangement 13 for feeding combustible material includes a chamber 31, covered by a door 32, beneath the level of a floor 33 from which material can be dumped when the door 32 is moved clear. A reciprocating ram 34 feeds material into the upper open end of the combustor cylinder cylinder 16.

As observed above, a basic combustor is further disclosed in said U.S. Pat. No. 3,822,651, a waste feeding ram is disclosed in U.S. Pat. No. 4,714,231, and a windbox air flow control is disclosed in U.S. Pat. No. 4,724,778, all three of which disclosures are hereby specifically incorporated by reference.

As disclosed in U.S. Pat. No. 4,724,778, the windbox 11 is divided both into sections 43, 44 and 45 along the length of the combustor and into pairs of sections, including section 44*a*, peripherally around the lower portion of the combustor. Because of the combustor rotation, material being burned rides up on one side of the combustor cylinder 16. The row of windbox sections including section 44*a* are positioned to deliver air beneath the burning material, thus delivering so-called underfire air, while the adjacent sections 43, 44, 45 deliver overfire air. In the illustrated embodiment, the windbox 11 is supplied with air under pressure by a blower 46.

In accordance with the invention, the combustion air being supplied to the combustor 10 as underfire air is controlled by intermittently arresting the air flow so that it is fed into the material being burned in a series of pulses. In the illustrated form, this is accomplished by mounting a valve plate 50 in the windbox section 44*a* for rotation between an air blocking position add an air passing position. The plate 50 rotates on a shaft 51 supported in bearings 52. The blocking position of the plate 50 is the horizontal position across the width of the windbox section 44*a*, and the passing position is with the plate 50 disposed vertically and offering little resistance to air flow through the windbox section 44*a* to the combustor 10. A motor 53 drives the plate 50 through pulleys 54 and a belt 55.

Rotation of the plate 50 alternately opens and closes the windbox section 44*a*, and thus generates air pulses which penetrate the material being burned in the combustor 10. The effect is somewhat analogous to puffing a bellows into the fire, thereby enhancing complete combustion. Also, by making the air flow intermittent, paper or similarly light, burnable material cannot be held suspended over the burning material as might be the case if the air flow was constant. Once the material falls into the fire, it is much more likely to be completely burned.

If a common source of combustion air is used for providing both underfire air as well as overfire air, "common" in the sense that air can pass between the windbox sections 44 and 44*a*, it may be desirable to, in effect, close the overfire air section 44 with a second valve plate, not shown, when the valve plate 50 is in its open position. The two valve plates would rotate 90° out of phase so that they are alternately open while the other is closed. This would avoid the possibility of air in the chamber 44*a* leading off to the chamber 44 when the valve plate 50 is closed with the result that the pressure in the chamber 44 becomes too low to drive air through the bed of material being burned after the plate 50 rotates open.

It will be apparent that the air pulsation effect desired has been simply and economically obtained through the provision of the rotating plate 50. Control of the rate at which air pulses are delivered to the combustor is easily obtained by varying the rotational speed at which the plate 50 is driven.

I claim is my invention:

1. In a combustor having a cylindrical drum formed of water cooled pipes joined by perforated strips so as to be air porous, said drum being slowly rotated on its axis and having an upper open end of receiving burnable material and a lower end for discharging ashes or non-burnable material, the combination comprising, a windbox fitted to the lower portion of said drum for delivering air to penetrate and react with the material being burned, means for delivering air to said windbox, a valve disposed in said air delivery means and drive means connected to said valve for continually arresting and commencing air flow so that air is delivered to the drum in fluctuating pressure pulses, whereby the fluctuating pressure pulses of air enhance complete combustion of the burnable material, said valve includes a valve plate mounted in said windbox for rotation through an air blocking position and an air passing position, and said drive means includes a motor for rotating said valve plate and thereby generating said fluctuating pressure pluses.

* * * * *